US009907122B2

(12) United States Patent
Himmelein et al.

(10) Patent No.: US 9,907,122 B2
(45) Date of Patent: Feb. 27, 2018

(54) OVEN DOOR FOR A MICROWAVE OVEN OR A MULTIFUNCTIONAL OVEN WITH MICROWAVE HEATING FUNCTION

(71) Applicant: Electrolux Home Products Corporation N. V., Brussels (BE)

(72) Inventors: Benjamin Himmelein, Rothenburg ob der Tauber (DE); Marian Militzer-Keil, Schleiz (DE); Trevor Specht, Rothenburg ob der Tauber (DE)

(73) Assignee: Electrolux Home Products Corporation N.V., Brussels (BE)

( * ) Notice: Subject to any disclaimer, the term of this patent is extended or adjusted under 35 U.S.C. 154(b) by 366 days.

(21) Appl. No.: 14/432,545

(22) PCT Filed: Oct. 31, 2013

(86) PCT No.: PCT/EP2013/072782

§ 371 (c)(1),
(2) Date: Mar. 31, 2015

(87) PCT Pub. No.: WO2014/072218

PCT Pub. Date: May 15, 2014

(65) Prior Publication Data

US 2015/0245422 A1 Aug. 27, 2015

(30) Foreign Application Priority Data

Nov. 12, 2012 (EP) ..... 12192251

(51) Int. Cl.
*H05B 6/76* (2006.01)
*H05B 6/64* (2006.01)

(52) U.S. Cl.
CPC ..... *H05B 6/6414* (2013.01); *H05B 6/763* (2013.01)

(58) Field of Classification Search
CPC ..... H05B 6/763; H05B 6/6414
(Continued)

(56) References Cited

U.S. PATENT DOCUMENTS 3,731,035 A * 5/1973 Jarvis ..... H05B 6/6414 126/190
2004/0149748 A1 8/2004 Leutner et al.
2005/0205564 A1 9/2005 Stahli

FOREIGN PATENT DOCUMENTS

DE 8905292 U1 6/1989
EP 0687867 A1 12/1995
(Continued)

OTHER PUBLICATIONS

International Search Report for PCT/EP2013/072782, dated Jan. 24, 2014, 6 pages.

*Primary Examiner* — Quang Van
(74) *Attorney, Agent, or Firm* — Pearne & Gordon LLP

(57) ABSTRACT

An oven door for a microwave oven or a multifunctional oven with microwave heating function is provided. The oven door includes an outer glass panel and at least two door columns directly attached or attachable at an inner side of the outer glass panel. The oven door further includes a door cover arranged or arrangeable at an inner side of the outer glass panel and attached or attachable at the door columns. The oven door also includes a door choke system arranged or arrangeable between the door cover and the outer glass panel. The oven door further includes an inner glass panel arranged or arrangeable between the door cover and the door choke system.

16 Claims, 7 Drawing Sheets

Figure 1:
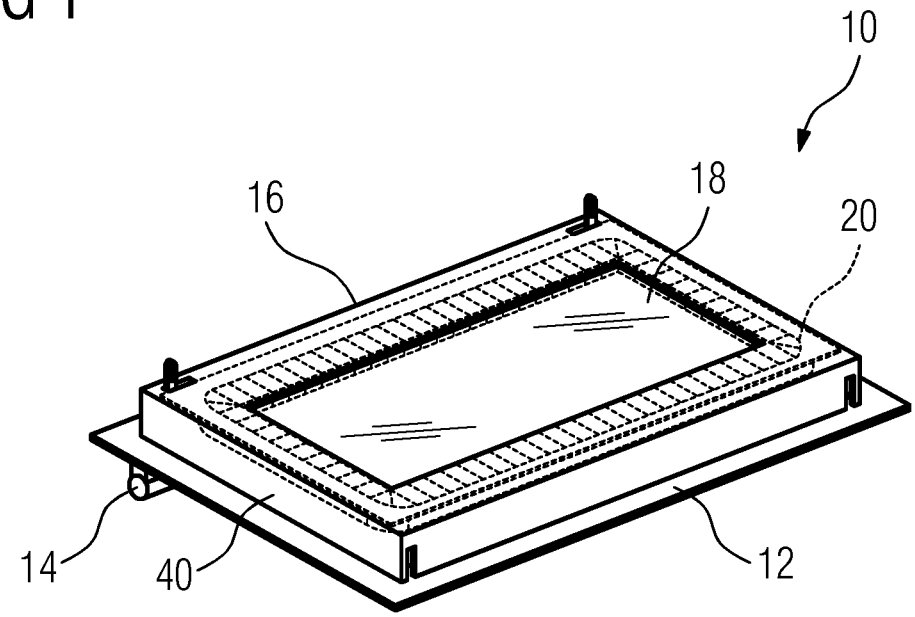

(58) Field of Classification Search
USPC ..... 219/739–744, 682; 126/20, 198
See application file for complete search history.

(56) References Cited

FOREIGN PATENT DOCUMENTS

| | | | |
|---|---|---|---|
| EP | 0811806 | A1 | 12/1997 |
| EP | 1555486 | A2 | 7/2005 |
| EP | 1850072 | A2 | 10/2007 |
| EP | 2291056 | A1 | 3/2011 |

* cited by examiner

OVEN DOOR FOR A MICROWAVE OVEN OR A MULTIFUNCTIONAL OVEN WITH MICROWAVE HEATING FUNCTION

The present invention relates to an oven door for a microwave oven or a multifunctional oven with microwave heating function. Further, the present invention relates to a microwave oven or a multifunctional oven with microwave heating function.

In a microwave oven or a multifunctional oven with a microwave heating function the oven door requires different features. The oven door has to be attached pivoting at a front frame of the oven by hinges. The hinges are often arranged inside the oven door and fixed by screws. One or two latches in an upper portion of the oven door are parts of a safety interlock system, wherein the other part of said safety interlock system is arranged in the top portion of the front frame. The latches are engageable with said parts in the front frame. Further, a wave choke system is required in order to prevent a microwave leakage. The components of the oven door usually require a lot of fixing elements.

It is an object of the present invention to provide an oven door for a microwave oven or a multifunctional oven with microwave heating function, wherein the oven door is constructed by low complexity.

The object of the present invention is achieved by the oven door according to claim 1.

The present invention relates to an oven door for a microwave oven or a multifunctional oven with microwave heating function, wherein

- the oven door comprises an outer glass panel,
- the oven door comprises at least two door columns directly attached or attachable at an inner side of the outer glass panel,
- the oven door comprises a door cover arranged or arrangeable at an inner side of the outer glass panel and attached or attachable at the door columns,
- the oven door comprises a door choke system arranged or arrangeable between the door cover and the outer glass panel, and
- the oven door comprises an inner glass panel arranged or arrangeable between the door cover and the door choke system.

The main idea of the present invention is the direct attachment of the door columns at the inner side of the outer glass panel on the one hand and the attachment of door cover at the door columns on the other hand, wherein the remaining components of the oven door are arranged between the outer glass panel and the door cover. This constellation allows a compact structure of the oven door and reduced the number of fixing elements. Thus, the oven door may be constructed by low complexity.

According to a special embodiment of the present invention the door columns are glued by an adhesive at the inner side of the outer glass panel. This simplifies the production of then oven door.

Alternatively, the door columns may be attached or attachable by screws at the inner side of the outer glass panel.

In particular, the door columns are made of plastics. This contributes to low costs.

For example, the door choke system includes at least one metal sheet with a circumferential channel.

Preferably, the door choke system includes at least one further metal sheet with a plurality of lamellae along the circumferential channel.

In particular, the door choke system includes a door grid in its central portion. The door grid allows shielding of microwave on the one hand and a transparent oven door on the other hand.

Further, the door choke system is fixed or fixable at the door columns. For example, the door choke system is fixed or fixable by screws at the door columns.

According to a preferred embodiment of the present invention the door cover includes a main wall extending in parallel to the inner glass panel and a circumferential wall perpendicular to said main wall.

In this case, the main wall of the door cover may include a recess in its centre, so the inner glass panel and the door cover form a window with an enclosing frame.

Moreover, at least one central glass panel may be arranged or arrangeable between the door columns on the one hand and between the outer glass panel and the door choke system on the other hand.

Preferably, the at least one central glass panel is aligned by retaining elements.

Further, the door column may include at least one latch element engageable with a safety interlock system of the oven.

For example, the door column and the latch element are formed as a single-piece part.

Alternatively, the latch element may be made of metal and inserted by moulding into the door column.

In particular, the door column includes a recess for receiving a hinge arm of a door hinge.

Preferably, the oven door comprises a door handle fixed or fixable at an outer side of the outer glass panel.

Further, the present invention relates to a microwave oven or a multifunctional oven with microwave heating function, wherein the oven comprises an oven door mentioned above.

Novel and inventive features of the present invention are set forth in the appended claims.

Figure 2:
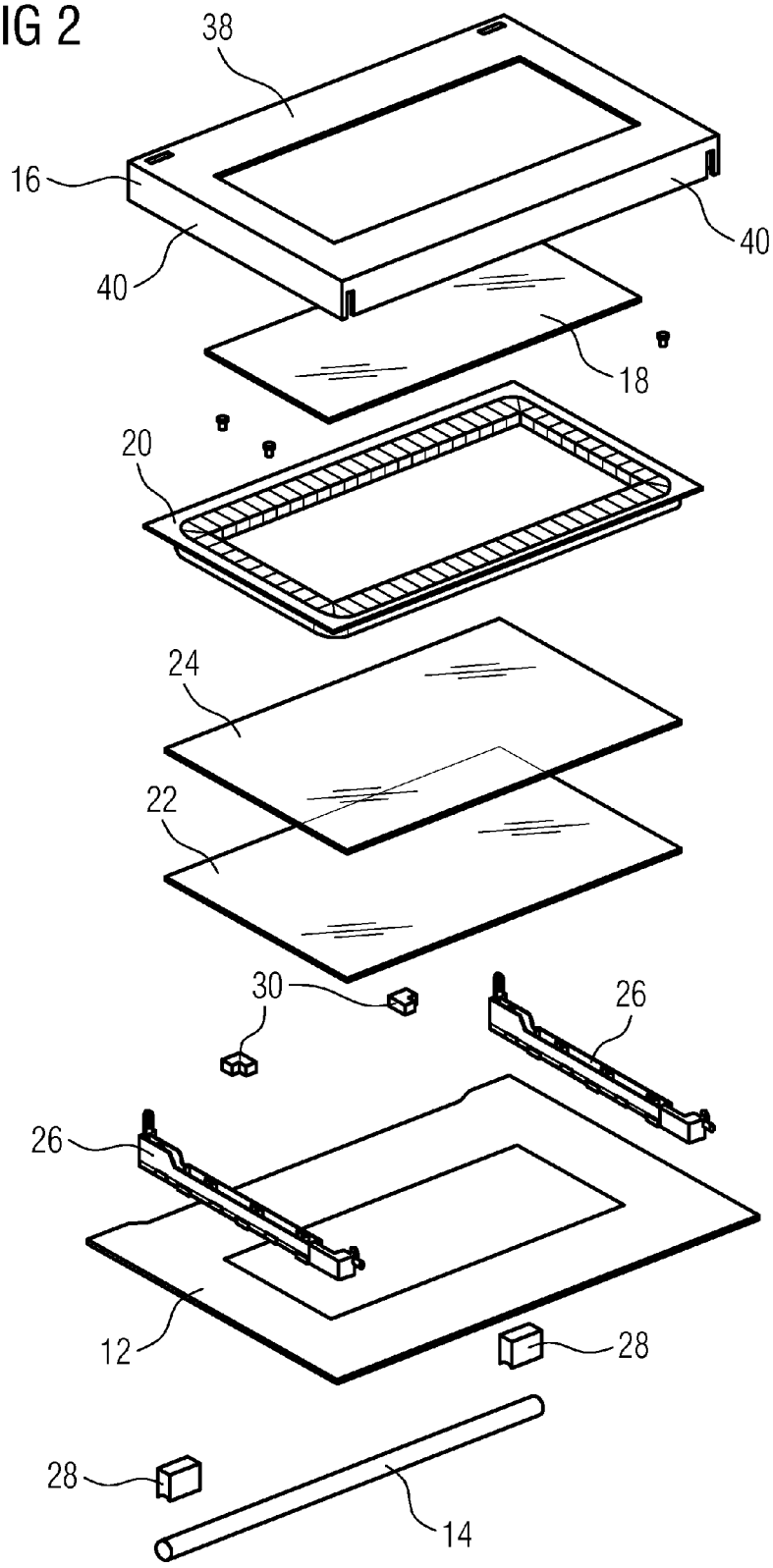
Figure 3:
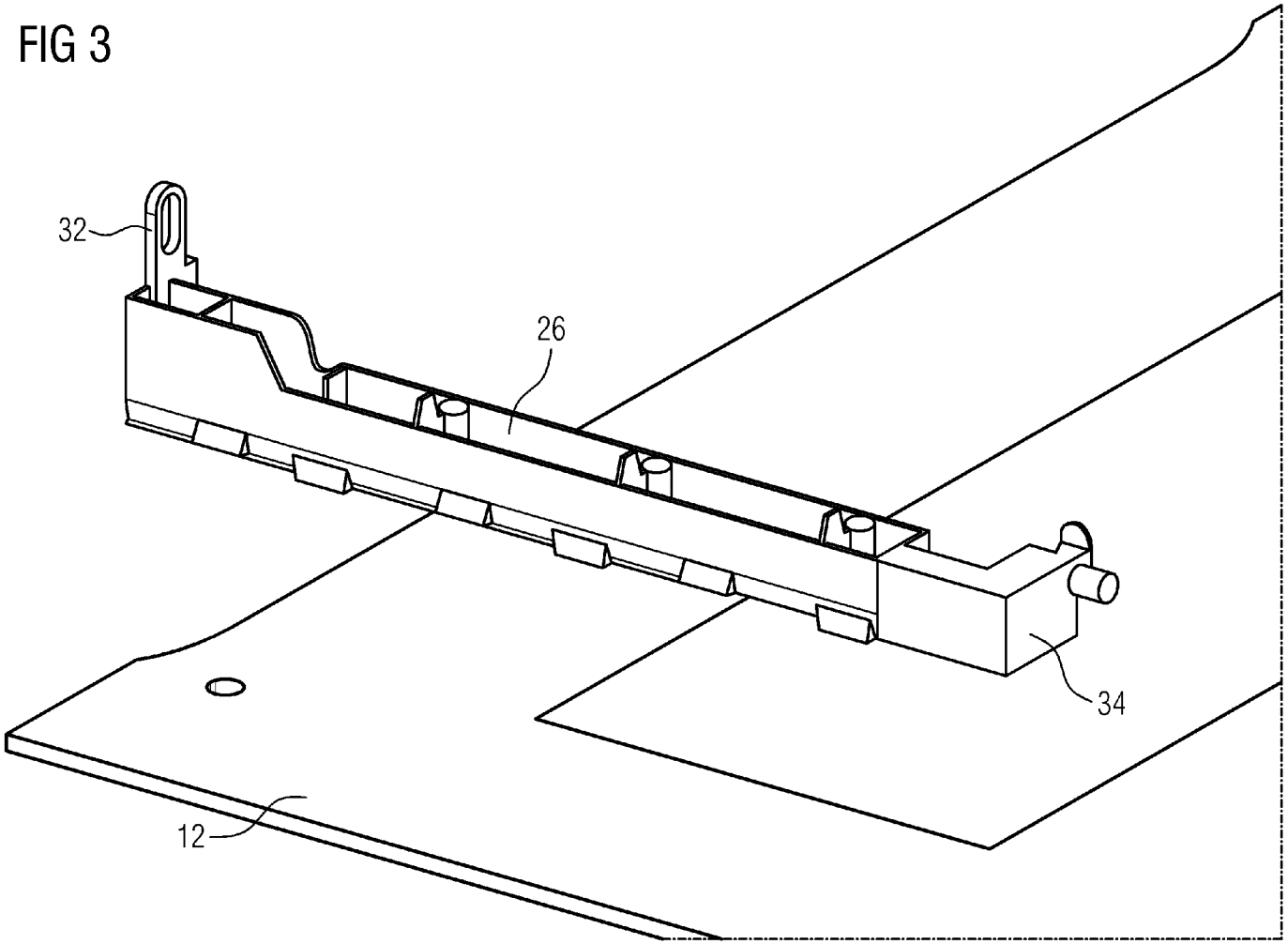
Figure 4:
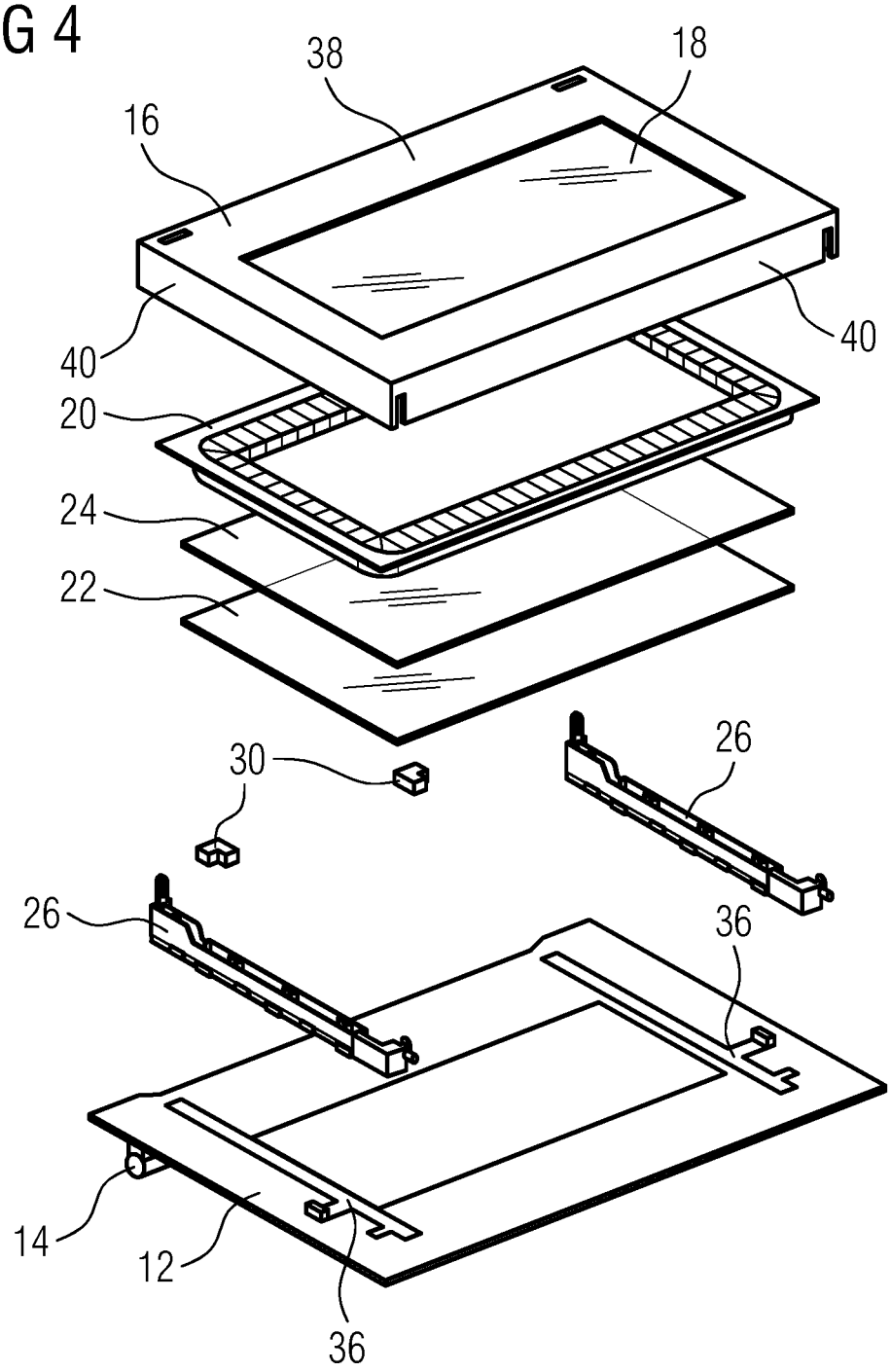
Figure 5:
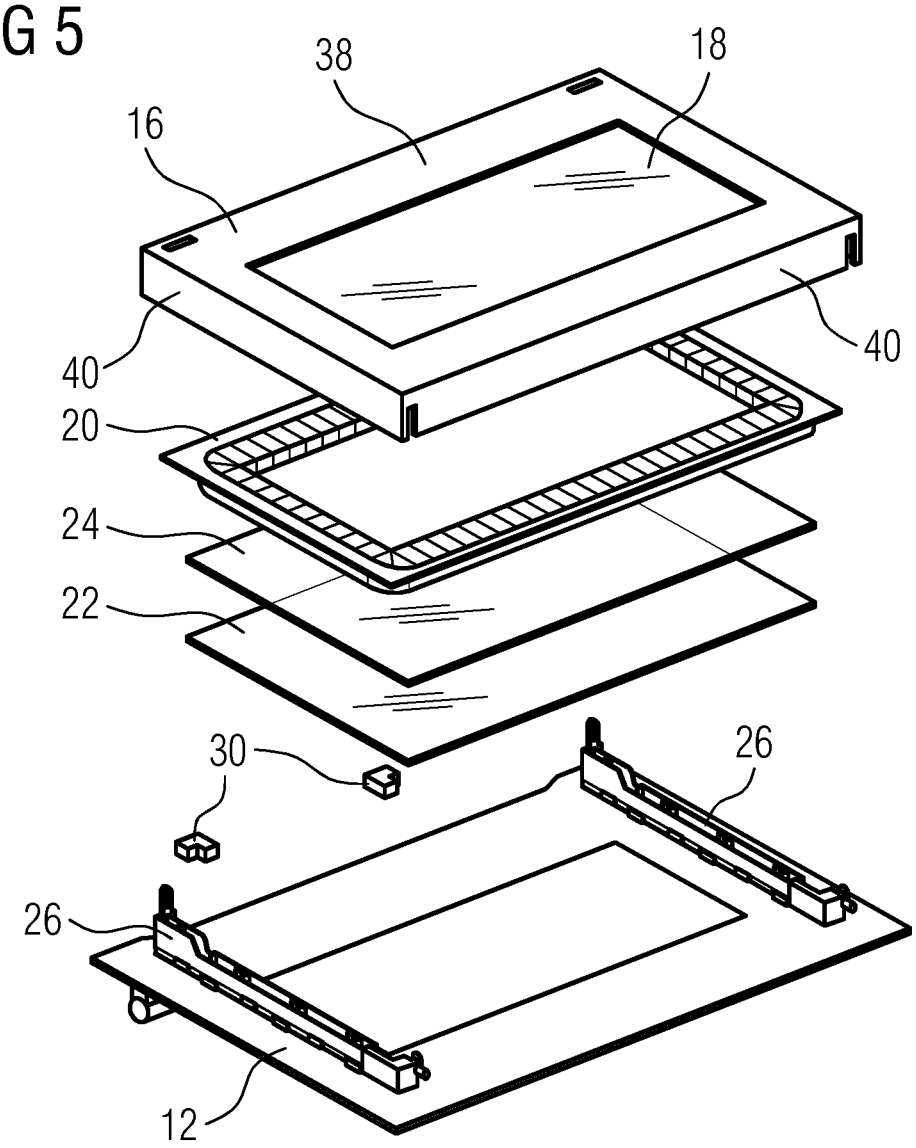
Figure 6:
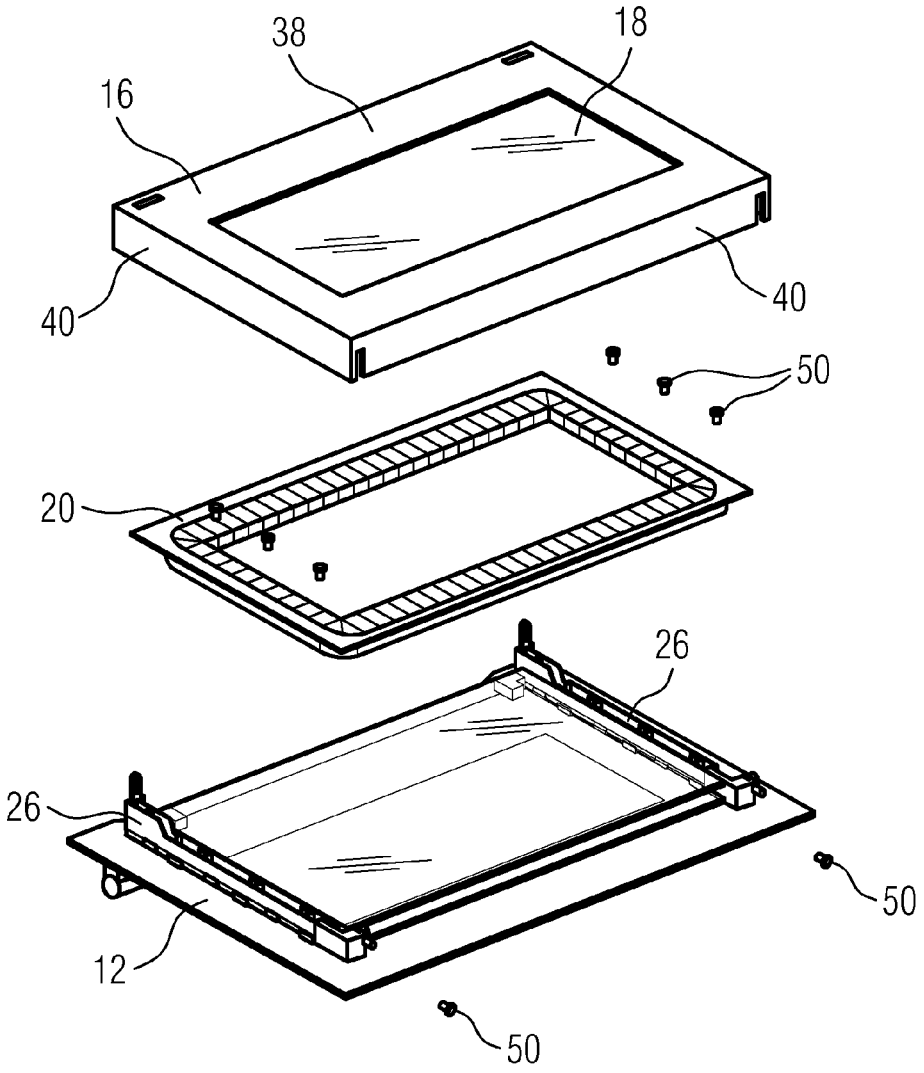
Figure 7:
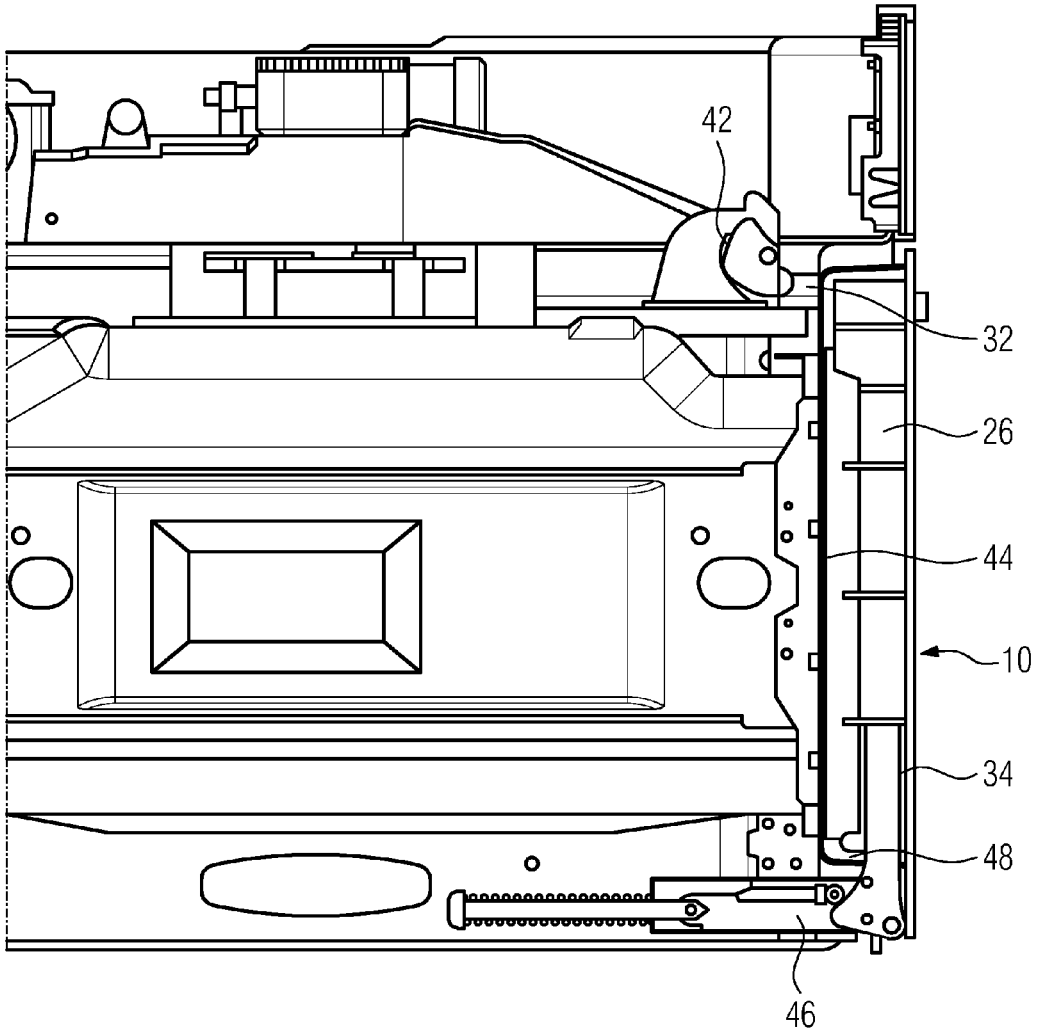

The present invention will be described in further detail with reference to the drawings, in which FIG. 1 illustrates a perspective view of an oven door for a microwave oven or a multifunctional oven with microwave heating function according to a preferred embodiment of the present invention, FIG. 2 illustrates an exploded perspective view of the oven door for the microwave oven or multifunctional oven with microwave heating function according to the preferred embodiment of the present invention, FIG. 3 illustrates a detailed exploded perspective view of a door column and an outer glass panel of the oven door for the microwave oven or multifunctional oven with microwave heating function according to the preferred embodiment of the present invention, FIG. 4 illustrates a further exploded perspective view of the oven door for the microwave oven or multifunctional oven with microwave heating function according to the preferred embodiment of the present invention, FIG. 5 illustrates another exploded perspective view of the oven door for the microwave oven or multifunctional oven with microwave heating function according to the preferred embodiment of the present invention, FIG. 6 illustrates a further exploded perspective view of the oven door for the microwave oven or multifunctional oven with microwave heating function according to the preferred embodiment of the present invention, and FIG. 7 illustrates a sectional side view of the oven door arranged at the microwave oven or multifunctional oven with microwave heating function according to the preferred embodiment of the present invention.

FIG. 1 illustrates a perspective view of an oven door 10 for a microwave oven or a multifunctional oven with microwave heating function according to a preferred embodiment of the present invention.

The oven door 10 comprises an outer glass panel 12, a door handle 14, a door cover 16, an inner glass panel 18, a door choke system 20, a first central glass panel 22, a second central glass panel 24 and two door columns 26.

The door handle 14 is attached at an outer side of the outer glass panel 12. The door cover 16 is attached at an inner side of the outer glass panel 12. The door cover 16 includes a main wall 38 and circumferential side walls 40, so that a space is formed between said door cover 16 and the outer glass panel 12. The inner glass panel 18, the door choke system 20, the first central glass panel 22, the second central glass panel 24 and the two door columns 26 are arranged inside said space. The main wall 38 of the door cover 16 includes a cutout, so that the door cover 16 and the inner glass panel 18 form a window with frame.

FIG. 2 illustrates an exploded perspective view of the oven door 10 for the microwave oven or multifunctional oven with microwave heating function according to the preferred embodiment of the present invention. FIG. 2 clarifies the arrangement and positions of the components of the oven door 10.

The door handle 14 is attached via distance elements 28 at an outer side of the outer glass panel 12. The door columns 26 are attached at the inner side of the outer glass panel 12. The first central glass panel 22 and the second central glass panel 24 are arranged between the door columns 26. Retaining elements 30 are provided for the alignment of the first central glass panel 22 and the second central glass panel 24. The inner glass panel 18 is attached at an outer side of the door cover 16. The door choke system 20 is arranged between the inner glass panel 18 and the second central glass panel 24.

FIG. 3 illustrates a detailed exploded perspective view of the door column 26 and the outer glass panel 12 of the oven door 10 for the microwave oven or multifunctional oven with microwave heating function according to the preferred embodiment of the present invention.

The door column 26 is elongated and provided for a vertical arrangement at the inner side of the outer glass panel 12. The two door columns 26 are arranged side-by-side and in parallel at the outer glass panel 12. The first central glass panel 22 and the second central glass panel 24 are arranged between said two door columns 26.

The door column 26 includes a latch element 32 at its upper end. The latch element 32 is an integrated part of the door column 26. For example, the latch element 32 and door column 26 may form a single-piece part. In this case, the door column 26 with latch element 32 is preferably made of plastics. Further, the latch element 32 may be made of metal and inserted by moulding into the door column 26 made of plastics. The latch element 32 is engageable with a safety interlock system 42 of the oven. In a closed state of the oven door 10 the latch element 32 is engaged with the safety interlock system 42 arranged in an upper portion behind a front frame of the oven.

A recess 34 in the lower portion of the door column 26 is provided for receiving a hinge arm of a door hinge. The oven door 10 is fixable at the oven by inserting two hinge arms of the door hinge into the door columns 26 of the oven door 10.

FIG. 4 illustrates a further exploded perspective view of the oven door 10 for the microwave oven or multifunctional oven with microwave heating function according to the preferred embodiment of the present invention. FIG. 4 shows a step during assembling the oven door 10.

An adhesive 36 is applied on those areas of the inner side of the outer glass panel 12, which are provided for the door columns 26. The gluing of the door columns 26 onto the outer glass panel 12 simplifies the assembling of the oven door 10. The first central glass panel 22 and the second central glass panel 24 are provided for the intermediate space between the door columns 26. The retaining elements 30 allow the alignment of the first central glass panel 22 and the second central glass panel 24.

The door cover 16 may be fixable at the door columns 26 by screws and/or by a snap-in mechanism. The inner glass panel 18 and the door choke system 20 are arranged between the door cover 16 and the second central glass panel 24.

FIG. 5 illustrates another exploded perspective view of the oven door 10 for the microwave oven or multifunctional oven with microwave heating function according to the preferred embodiment of the present invention. FIG. 5 is similar to FIG. 4, wherein the door columns 26 are glued onto the outer glass panel 12.

FIG. 6 illustrates a further exploded perspective view of the oven door 10 for the microwave oven or multifunctional oven with microwave heating function according to the preferred embodiment of the present invention. FIG. 6 is similar to FIG. 5, wherein the first central glass panel 22 and the second central glass panel 24 are already inserted between the door columns 26.

In this example, the door choke system 20 is made of two metal sheets. An outer metal sheet includes a circumferential channel for a wave trap. An inner metal sheet includes a plurality of lamellae for the wave trap.

Screws 50 may be provided for fixing the door cover 16 at the door columns 26. Further, the screws 50 may be provided for connecting the inner metal sheet of the door choke system 20 to the outer metal sheet of said door choke system 20. Moreover, the screws 50 may be provided for connecting the door choke system 20 to the door columns 26.

FIG. 7 illustrates a sectional side view of the oven door 10 arranged at the microwave oven or multifunctional oven with microwave heating function according to the preferred embodiment of the present invention.

The oven door 10 is arranged in front of a front frame 44 of the oven. FIG. 7 clarifies the arrangement of the door column 26 inside the oven door 10. The latch element 32 is an integrated part of the door column 26. The latch element 32 is engaged with the safety interlock system 42 arranged behind the upper portion of the front frame 44.

The door hinge 46 is arranged at the oven below the front frame 44. The hinge arm 48 of the door hinge 46 is received by the recess 34 of the door column 26. The oven door 10 is easily fixable at the oven by inserting two hinge arms 48 of the door hinge 46 into the door columns 26 of the oven door 10.

Although an illustrative embodiment of the present invention has been described herein with reference to the accompanying drawings, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 oven door
12 outer glass panel

14 door handle
16 door cover
18 inner glass panel
20 door choke system
22 first central glass panel
24 second central glass panel
26 door column
28 distance element
30 retaining element
32 latch element
34 recess
36 adhesive
38 main wall
40 circumferential wall
42 safety interlock system
44 front frame
46 door hinge
48 hinge arm
50 screw

The invention claimed is:

1. An oven door for a microwave oven or a multifunctional oven with microwave heating function, said oven door comprising:

an outer glass panel, at least two door columns directly attached at an inner side of the outer glass panel, a door cover arranged at the inner side of the outer glass panel and attached at the door columns, a door choke system arranged between the door cover and the outer glass panel, and an inner glass panel arranged between the door cover and the door choke system, wherein the door cover includes both a main wall extending in parallel to the inner glass panel and a circumferential side wall perpendicular to said main wall, said main wall and said circumferential side wall forming a space between the door cover and the outer glass panel, and wherein the inner glass panel, the door choke system, and the two door columns are arranged inside said space.

2. The oven door according to claim 1, wherein the door columns are glued by an adhesive at the inner side of the outer glass panel or in that the door columns are attached by screws at the inner side of the outer glass panel.

3. The oven door according to claim 1, wherein the door columns are made of plastics.

4. The oven door according to claim 1, wherein the door choke system includes at least one metal sheet with a circumferential channel.

5. The oven door according to claim 4, wherein the door choke system includes at least one further metal sheet with a plurality of lamellae along the circumferential channel.

6. The oven door according to claim 4, wherein the door choke system includes a door grid in its central portion.

7. The oven door according to claim 1, wherein the door choke system is fixed by screws at the door columns.

8. The oven door according to claim 1, wherein the main wall of the door cover includes a recess in its centre, so the inner glass panel and the door cover form a window with an enclosing frame.

9. The oven door according to claim 1, wherein at least one central glass panel is arranged between the door columns on the one hand and between the outer glass panel and the door choke system on the other hand.

10. The oven door according to claim 9, wherein the at least one central glass panel is aligned by retaining elements.

11. The oven door according to claim 1, wherein the door column includes at least one latch element configured to engage with a safety interlock system of the oven.

12. The oven door according to claim 11, wherein the door column and the latch element are formed as a single-piece part or in that the latch element is made of metal and inserted by moulding into the door column.

13. The oven door according to claim 1, wherein the door column includes a recess for receiving a hinge arm of a door hinge.

14. The oven door according to claim 1, further comprising a door handle fixed at an outer side of the outer glass panel.

15. The oven door according to claim 14, wherein the door handle is fixed at the outer side of the outer glass panel via distance elements.

16. A microwave oven or a multifunctional oven with microwave heating function, said oven comprising an oven door according to claim 1.

* * * * *